US007141002B2

(12) United States Patent
Connelly

(10) Patent No.: US 7,141,002 B2
(45) Date of Patent: Nov. 28, 2006

(54) EXERCISE APPARATUS

(76) Inventor: Albert Louis Connelly, 49 Channing Dr., Ringwood, NJ (US) 07456

( * ) Notice: Subject to any disclaimer, the term of this patent is extended or adjusted under 35 U.S.C. 154(b) by 596 days.

(21) Appl. No.: 10/612,645

(22) Filed: Jul. 2, 2003

(65) Prior Publication Data

US 2004/0162199 A1 Aug. 19, 2004

Related U.S. Application Data

(60) Provisional application No. 60/446,927, filed on Feb. 12, 2003.

(51) Int. Cl.
*A63B 23/16* (2006.01)
*A63B 21/075* (2006.01)

(52) U.S. Cl. ..... 482/50; 482/44; 482/93; 482/109

(58) Field of Classification Search ..... 482/44–50, 482/83, 92–94, 104–110, 14, 20, 97, 148, 482/98, 139; 601/40; 473/256, 437
See application file for complete search history.

(56) References Cited

U.S. PATENT DOCUMENTS 1,779,594 A * 10/1930 Hall ..... 482/107
2,244,351 A * 6/1941 Venables ..... 482/107
2,470,816 A 5/1949 Harvey
3,022,073 A * 2/1962 Miller ..... 482/106
3,265,389 A * 8/1966 Carlson ..... 482/49
3,666,267 A 5/1972 McKinney
3,807,730 A 4/1974 Dalton et al.
4,288,073 A * 9/1981 Petrachonis et al. ..... 482/106
4,482,151 A * 11/1984 Zwilling ..... 482/106
4,515,364 A * 5/1985 Rotella ..... 482/139
4,529,197 A * 7/1985 Gogarty ..... 482/107
4,695,051 A 9/1987 Jenison
4,730,827 A * 3/1988 Williams ..... 482/47
4,828,249 A * 5/1989 Keating ..... 482/48
4,921,246 A * 5/1990 Hornbostel ..... 482/106
5,060,933 A 10/1991 Cedro
5,078,392 A * 1/1992 Kracht ..... 482/107
5,137,502 A * 8/1992 Anastasi ..... 482/106

(Continued)

FOREIGN PATENT DOCUMENTS

CH 642266 A * 4/1984

(Continued)

OTHER PUBLICATIONS

Narragansett Machine Company—Ajustable Bar-Bell, Catalog of Gymnastic Apparatus, p. 114, 1925.*

(Continued)

*Primary Examiner*—Jerome Donnelly
*Assistant Examiner*—Victor K. Hwang
(74) *Attorney, Agent, or Firm*—Miller Patent Services; Jerry A. Miller

(57) ABSTRACT

A weightlifting apparatus consistent with certain embodiments of the present invention has a bar having a first and a second opposing end. A weight having a central aperture is dimensioned so that the bar can be passed through the aperture. The bar has an end cap having an outer dimension larger than that of the bar and the aperture, with the end cap being situated adjacent the first end of the bar. A clamp secures the weight to the bar adjacent the end cap. An aperture through the bar adjacent the second end of the bar is provided for either pivotal or direct attachment of the gripping plate. The gripping plate may be round, elliptical, continuously variable diameter, or irregular or other shapes. The gripping plate may be firm and flexible and have weights built into the plate itself.

58 Claims, 5 Drawing Sheets

U.S. PATENT DOCUMENTS

| | | | | |
|---|---|---|---|---|
| 5,207,624 | A | 5/1993 | Paskovich | |
| 5,221,244 | A * | 6/1993 | Doss | 482/106 |
| 5,281,192 | A | 1/1994 | Nelson | |
| 5,399,135 | A * | 3/1995 | Azzouni | 482/106 |
| 5,709,634 | A * | 1/1998 | Pointer | 482/105 |
| 5,741,206 | A * | 4/1998 | Anastasi | 482/105 |
| 5,967,949 | A | 10/1999 | Davenport | |
| 6,099,437 | A | 8/2000 | DeMers | |
| 6,149,555 | A | 11/2000 | Kinback | |
| 6,152,858 | A | 11/2000 | Kolb | |
| 6,228,001 | B1 * | 5/2001 | Johnson et al. | 482/48 |
| 2003/0004041 | A1 * | 1/2003 | Hartman et al. | 482/106 |
| 2003/0228960 | A1 * | 12/2003 | Martinez | 482/93 |

FOREIGN PATENT DOCUMENTS

| | | | |
|---|---|---|---|
| GB | 2162076 | * | 1/1986 |

OTHER PUBLICATIONS

International Search Report and Written Opinion for corresponding PCT application, International Application No. PCT/US04/19334.

"Aquabells™ Travel Weights", information from www.aquabells.com, date unknown, printed Sep. 15, 2003.

"Aquabells Travel Weights Dumbbells" product packaging, undated.

"Aquabells Travel Weights Ankle Weights" product packaging, undated.

* cited by examiner

FIG. 10A
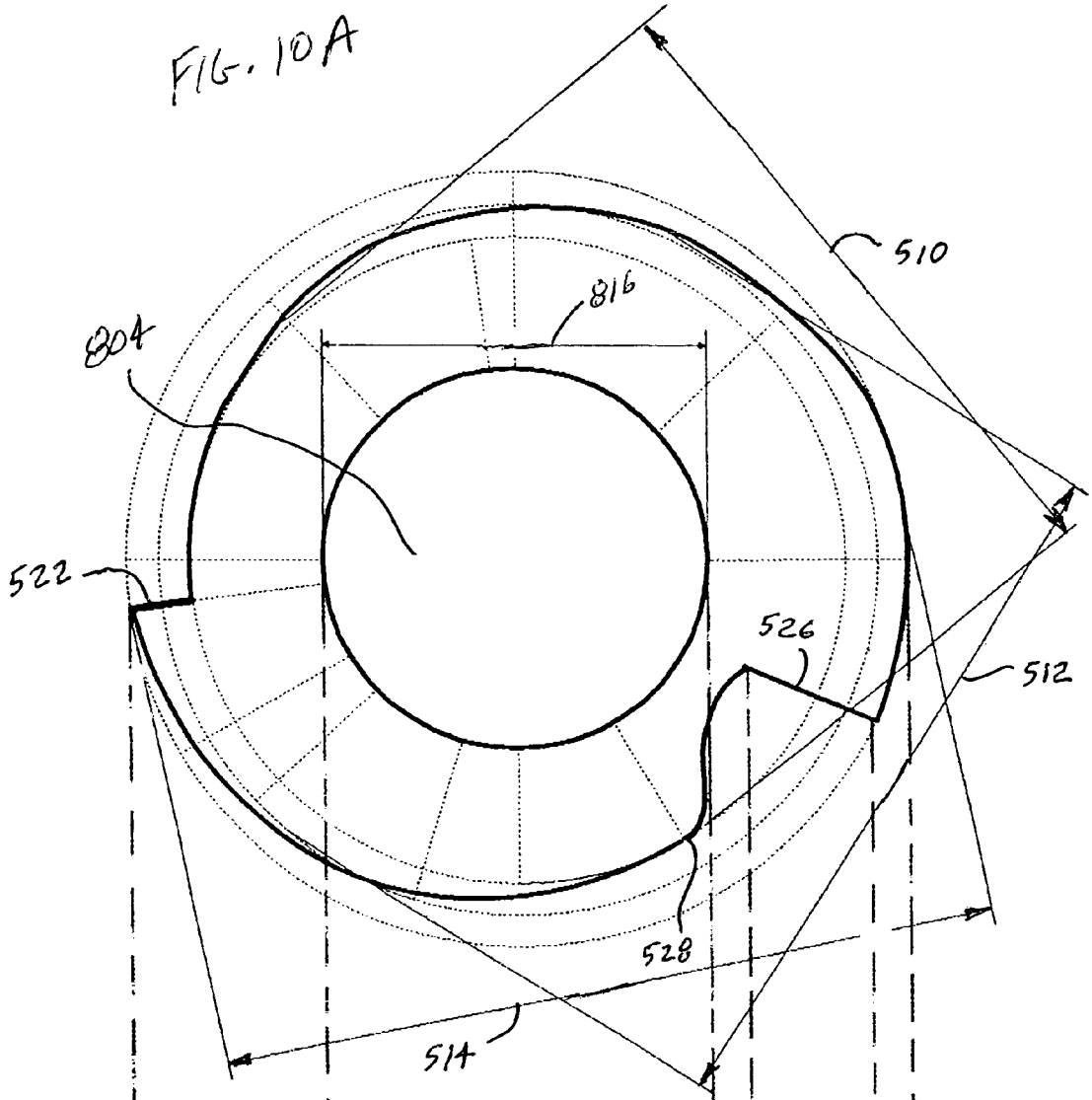
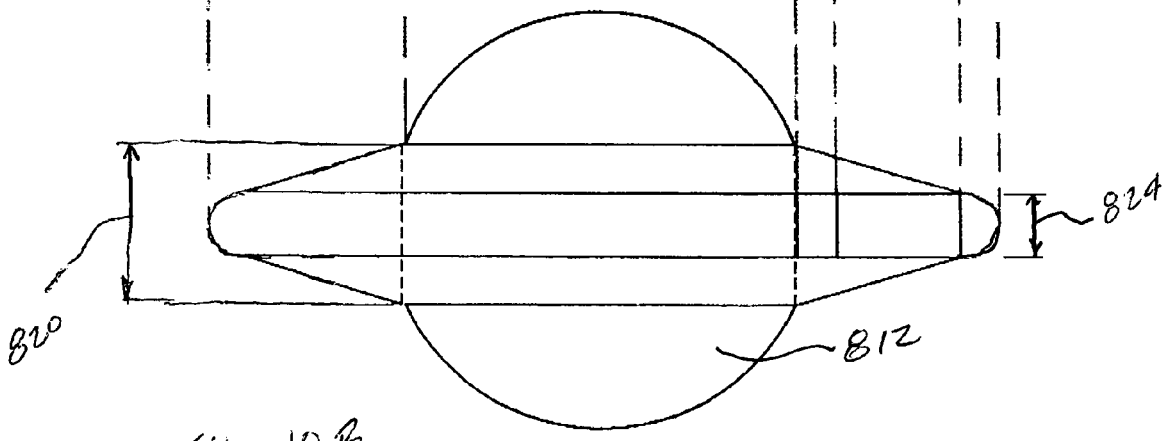
FIG. 10B

EXERCISE APPARATUS

CROSS REFERENCE TO RELATED DOCUMENTS

This application is related to U.S. provisional patent application Ser. No. 60/446,927, filed Feb. 12, 2003, to Albert Connelly entitled "Weightlifting Apparatus", which is hereby incorporated by reference.

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

FIELD OF THE INVENTION

The present invention relates generally to the field of exercise equipment, and more particularly, in certain embodiments consistent with the invention, to free weight devices to facilitate certain types of exercise and to a hand, arm and finger exercise device for use with and without free weights.

BACKGROUND

In order to accomplish an increase in the strength and/or mass of a muscle, the muscle is generally overloaded. One of the most common ways to achieve muscle overload is through repetitive lifting of weights, sometimes referred to as resistance training.

In the martial arts there is a series of blocking maneuvers that rely on external rotation of the forearm. The blocks are sometimes converted into grabs of an opponent's arm or directly into strikes at the opponent. Finger strength is important for certain advanced techniques that entail striking the opponent with tips of the fingers and then grasping their flesh to induce pain. In Okinawa, Japan, the geographic origin of karate, exercises to develop arm strength for these maneuvers were traditionally done with stone weights at the end of short wooden shaft. As karate students became stronger they got bigger stones to work with. Karate students developed finger and hand strength by grasping with their finger tips the lips of clay jars filled with sand. The jars would then be picked up and carried about. The amount of sand was increased as the students became stronger. In the United States the traditional methods are sometimes used today with cement blocks at the end of a shaft and various traditional and contemporary exercises are utilized for developing finger strength.

BRIEF DESCRIPTION OF THE DRAWINGS

An exemplary embodiment of the invention is depicted in the drawings that follow. Many variations and modifications will occur to those skilled in the art upon consideration of the teachings herein with reference to the above text taken in conjunction with the following drawings that depict an exemplary weightlifting device consistent with certain embodiments of the invention.

FIG. 10, which is made up of FIG. 10A and FIG. 10B, shows top and side views of a weightlifting apparatus consistent with certain embodiments of the present invention.

DESCRIPTION OF THE INVENTION

Figure 2:
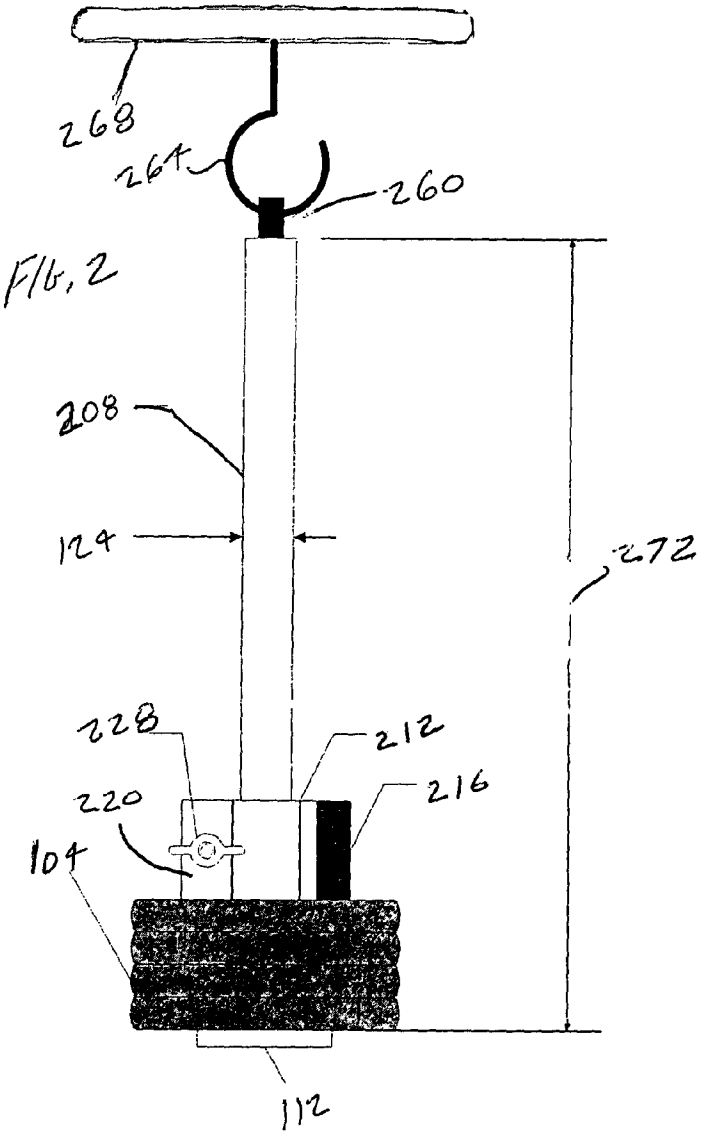
FIG. 2 is a front view of another embodiment of a weightlifting apparatus consistent with the present invention.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described.

The present invention relates generally to the field of exercise equipment, and more particularly, in certain embodiments consistent with the invention, to a free weight device to facilitate certain types of exercise. Certain embodiments consistent with the present invention relate to a device for lifting weights for development of the fingers, hands, wrists, arms, and shoulders. In several embodiments, the device allows the use of conventional off-the-shelf weights for the major portion of the weight, but other embodiments could use customized weights. Such embodiments may have a weight bar with weights added to one end of the bar. The opposite end of the bar can be used as a handle and for attachment of gripping plates used for wrist and finger strength development.

With traditional weight lifting tools the amount of weight cannot be easily and incrementally varied. Thus, in a karate studio using these tools, many weight sets may be needed. Moreover, there is currently no known commercially available way that weights from standard weight lifting apparatus can be used. Variable space and money are therefore consumed in a facility that wishes to provide the ability to replicate these exercises to multiple patrons with differing weight needs and hand sizes simultaneously.

In accordance with certain embodiments consistent with the invention, off-the-shelf weights can be used in one integrated unit while preserving the essential structure of the traditional apparatus of Okinawa. In certain embodiments, a weight bar is provided for repetitious manipulation by a weightlifter. The bar can have an end cap and a clamp secured by the weightlifter for keeping the weights at one end of the bar. If desired, the person exercising can use a weighted bar in each hand. Opposite the end cap, at the handle, there is a pivotal or fixed mechanism for attachment of a gripping plate or gripping disk. The gripping plate can be used for exercises that develop the fingers, hands, and wrists.

In certain embodiments, the invention provides for use of multiple handle sizes to accommodate the needs of users with different hand sizes. Certain embodiments consistent with the present invention has an integrated one piece handle, however a larger unit with a detachable larger handle (i.e., a two piece handle) can also be provided. A sleeve can also be used to provide a larger diameter handle. Elliptical, variable diameter or multi-diameter gripping disks can be provided in certain embodiments for accommodation of various hand sizes. The disks can be provided in various sizes to accommodate different hand sizes. The elliptical disks, variable diameter disks and the multi-diameter disks allow one disk to serve multiple hand sizes.

In one exemplary use, the weighted handle is hung by a pivoting attachment mechanism from the gripping disk. The user then lifts the weights by flexing the fingers and/or wrist upward to lift the weight by the gripping plate. Usually, but not necessarily, this is done using two such weight devices (one for each hand) and lifting with both hands simultaneously. The arms may also be lifted up to the horizontal position and the hand rotated about the wrist, thus developing the muscles of the top of the hand. Of course, other exercises may also be performed with devices consistent with the present invention.

In certain exemplary uses where the weight is integrated into the gripping disk and the disk is made of a firm, flexible material, the exercise device can be quite portable. Finger exercises can involve the finger muscles in a dynamic way, and the wrist can be flexed in the exercises. This allows the device to be easily adapted to all sorts of exercises. For example, in addition to training for the martial arts, hand development for pistol shooters and those in need of certain types of physical therapy of the hands can potentially benefit.

Figure 1:
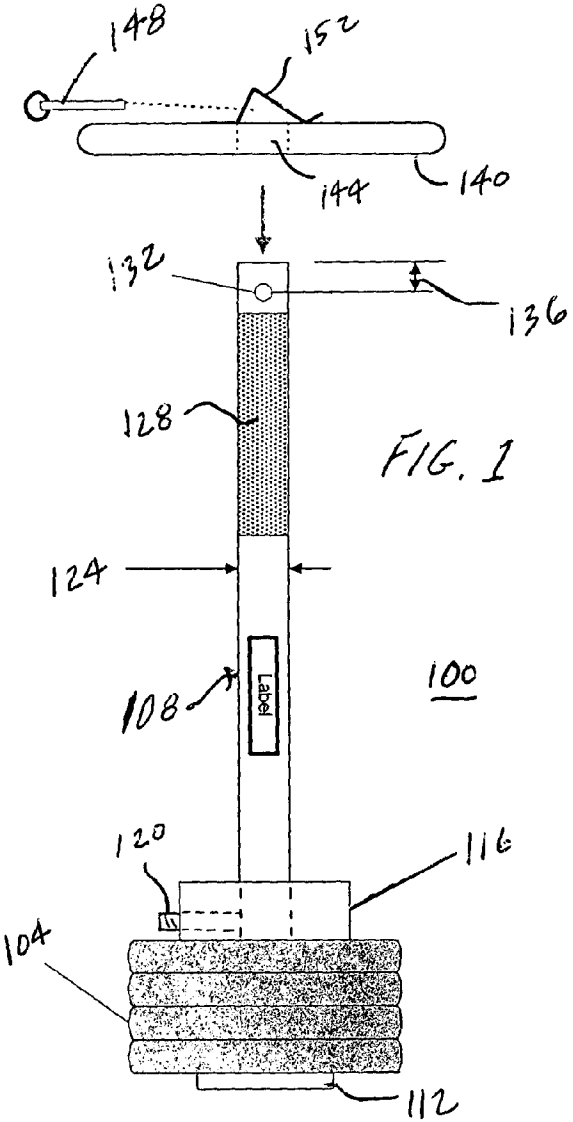
FIG. 1 is front view of a weightlifting apparatus consistent with certain embodiments of the invention.

Referring now to FIG. 1, a weightlifting apparatus 100 consistent with certain embodiments of the present invention is depicted in a side view. One or more standard commercially available barbell weights 104 (four shown) of the type having a central aperture for attachment to a barbell bar are threaded over a bar 108 from the top end. A flange or end cap 112 that is attached to or integrally formed with the bar 108 serves to stop the weights 104 from slipping off the lower end of the bar. The weights can be secured to the bar in place adjacent the end cap using any of a number of structures. In this illustrative embodiment, the bar is passed through a removable collar 116 having a central aperture and the collar is locked into place to secure the bar. In this embodiment, the collar is secured using a set screw 120 (e.g., a hex head set screw driven with an Allen wrench), but other mechanisms for securing the collar are equivalent. The collar and set screw should be considered a type of clamp for purposes of this discussion. In other embodiments, the collar may be fixed and hold a specific amount of weight permanently to the bar, or the bar may be fabricated to incorporate a fixed amount of weight. Other mechanisms for securing the collar or otherwise securing the weights in place could be readily substituted without departing from the present invention. In this arrangement, the weights are suspended from the gripping plate to permit a user to perform exercises by lifting the weight using the hand and/or fingers holding the gripping plate.

Many commercially available weights are available with a central aperture that is dimensioned to allow passage of a one inch bar. Thus, in one embodiment, the bar can have an outer diameter 124 of approximately one inch to allow passage of such weights, but this should not be considered limiting. The bar 108 may have a textured area 128 imprinted in the bar or may otherwise be textured in a handle area adjacent the upper end as shown.

In order to utilize the apparatus 100 for certain hand, wrist, arm and finger exercises, a hole 132 is formed in the bar near the upper end thereof. The hole can be centered approximately one half inch from the top of the bar as shown by dimension 136. A gripping disk or gripping plate 140 having an aperture 144 therein can then be passed over the upper end of the bar 108 and pivotally secured in place by passing a pin such as a quick release pin 148 through a clip 152 attached to the upper surface of the gripping disk.

Thus, in an exemplary embodiment as described above, a weightlifting device consistent with certain embodiments of the invention has a weight bar 108 for repetitious manipulation by a weightlifter. The bar 108 has an end cap 112 and a collar 116 or clamp or other suitable equivalent mechanism to secure the weights 104 at one end of the bar 108. Opposite the end cap 112, at the other end of the bar that serves as a handle, there is a mechanism (in this case, pin 148, clip 152 and aperture 132 for pivotal attachment of gripping disks.

For purposes of this document, the terms "gripping disk" or "gripping plate" synonymously refer to any suitably shaped structure that can be used to carry out the exercises described herein, whether disk shaped, elliptical shaped, oval shaped, irregularly shaped, variable diameter shapes, multi-diameter shapes, hand or finger contour shaped, or any other suitable shape without limitation by the conventional meaning of the term "disk." The gripping plates or gripping disks are used for exercises that develop the fingers, hands, and wrists. Elliptical gripping plates, variable diameter and multi-diameter contour shaped gripping plates can be provided for accommodation of various hand sizes, or other shapes can be used. This embodiment integrates functions normally performed by several devices into a single device and can be realized in an embodiment that uses off-the-shelf weights to permit the user to vary the weight loading of the device without need to purchase special weights.

Thus, in accordance with certain embodiments consistent with the present invention, a weightlifting apparatus for use in conjunction with an exercise weight of the type that has a central aperture that permits the weight to be secured to various weightlifting appliances has a bar having a first and a second opposing end. A weight is secured weight adjacent the first end of the bar. A mechanism is provided adjacent the second end of the bar for pivotal attachment of a gripping plate.

Figure 5:
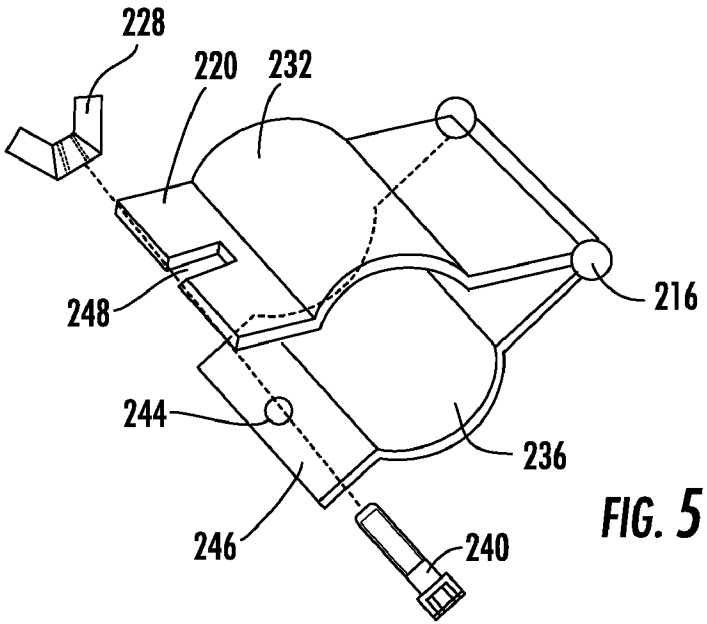
FIG. 5 illustrates a weight securing clamp mechanism suitable for use with certain embodiments of the invention.

Another illustrative example embodiment 200 is depicted in FIG. 2. In this exemplary embodiment, like reference numerals represent similar or identical elements as described in conjunction with device 100. In this embodiment, bar 208 has an un-textured handle and the weights 104 are secured in place with a clamp mechanism 212 that has a hinge side 216 that has a hinge mechanism and a closure side 220 secured with a wing nut 228 as illustrated more clearly in FIG. 5. The clamp has a pair of body portions 232 and 236 that are curved to mate with the bar 208. The clamp is wrapped around the bar 208 with a bolt 240 passing through aperture 244 on surface 246 and slot 248. The bolt is secured in place with wing nut 228 which is tightened to cause clamping pressure to be applied to the bar 208 and secure the clamp, and thus the weights 104, in place.

Referring back to FIG. 2, the top end of bar 208 incorporates an eye 260 through which a hook 264 passes. Hook 264 is attached to a gripping disk 268, so that the weights can be pivotally suspended from the gripping disk. In device 100 and device 200 (as well as other embodiments), the length of bar 108 or 208 can be any desired length. In certain embodiments, a range from approximately twelve to twenty inches at dimension 272 may be suitable, but other lengths are also within the scope of the present invention.

Figure 3:
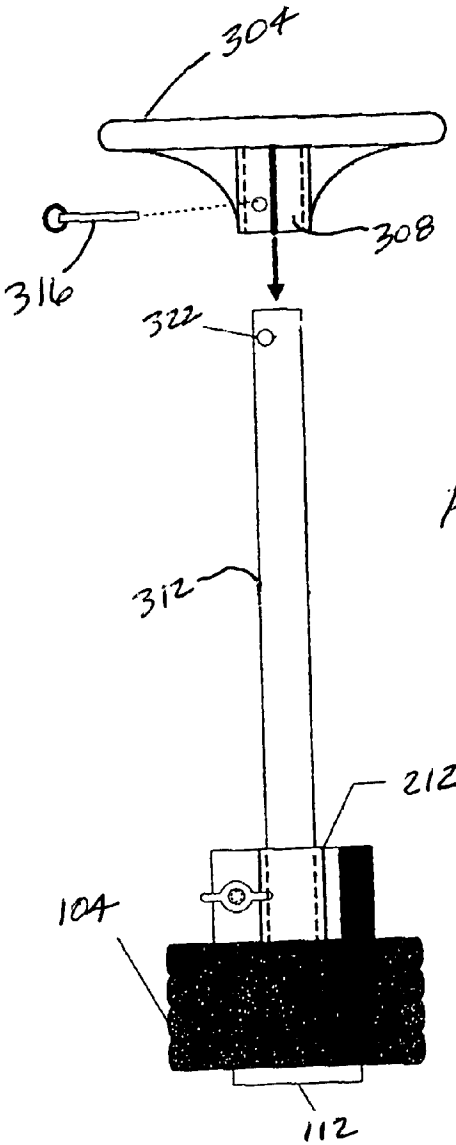
FIG. 3 is a front view of yet another embodiment of a weightlifting apparatus consistent with the present invention.

Another exemplary embodiment is shown in FIG. 3. This embodiment differs from FIG. 1 by having a gripping plate 304 that has an integrated sleeve 308 that is used to secure the gripping plate 304 to the shaft 312 by use of a pin 316 that passes through the sleeve 308 and the shaft 312 holding the weights 104. The clamping arrangement shown is similar to that of FIG. 2, but any suitable clamping arrangement can be used. As illustrated, the hole 322 in shaft 312 can be offset from center if desired.

Figure 4:
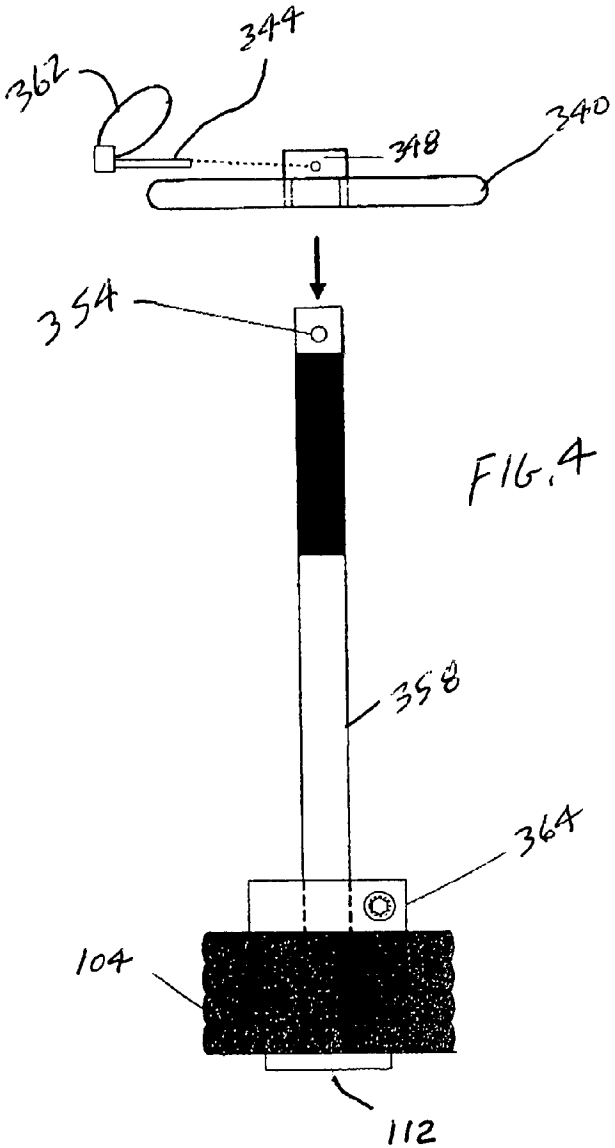
FIG. 4 is a front view of still another embodiment of a weightlifting apparatus consistent with the present invention.

FIG. 4 depicts another exemplary embodiment similar to that of FIG. 1. This embodiment differs in several respects. The gripping plate 340 is secured with a clik pin 344 that passes through a collar 348 in the gripping plate 340 and aperture 354 the shaft 358. After the pin 344 is inserted, a loop 362 of the clik pin 344 flips over the collar 348, thereby inhibiting the pin from slipping out. The clamp in this embodiment is a split shaft collar 364 secured by a screw to cause the split shaft collar 364 to close and grip the shaft 358.

Figure 6:
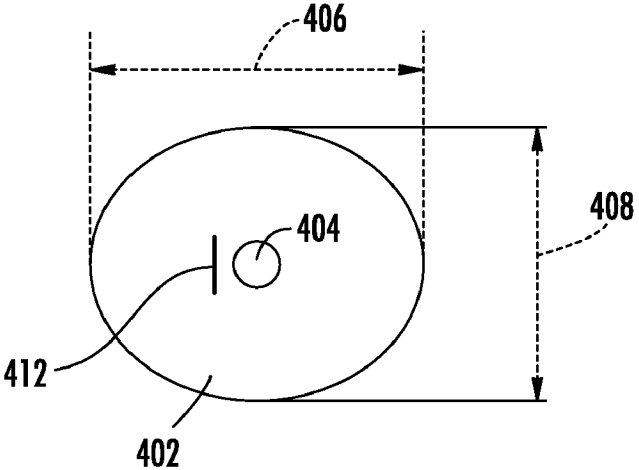
FIG. 6 is a top view illustrating an elliptical shaped gripping plate consistent with certain embodiments of the invention.

As previously mentioned, any number of shapes can be adapted for use as gripping plates. Circular gripping disks ranging in diameter from approximately four inches to approximately four inches to approximately six inches are suitable for most human hands. In order to reduce the number of gripping disks that might be needed by a commercial exercise facility (e.g., a gym or dojo), other gripping plate shapes can be used to handle more than one hand size per disk. One embodiment is depicted in FIG. 6 as an elliptical gripping plate 402 with central aperture 404. By using an ellipse shape, the user can find a comfortable size for his or her hand using either the longer dimension 406 or the shorter dimension 408. For certain embodiments, the long dimension can be either five or six inches and the shorter dimension 408 can be either 4½ inches or 5½ inches, but such dimensions should not be considered limiting and should only be viewed as approximate guidelines. Using such elliptical gripping plates, a set of two gripping plates will cover a wide range of hand sizes. Other sizes could also be used without departing from the invention. When used in conjunction with device 100, a clip 152 can be mounted at 412, but collars, sleeves or other mechanisms to facilitate attachment to a shaft can be devised without departing from the present invention.

Figure 7:
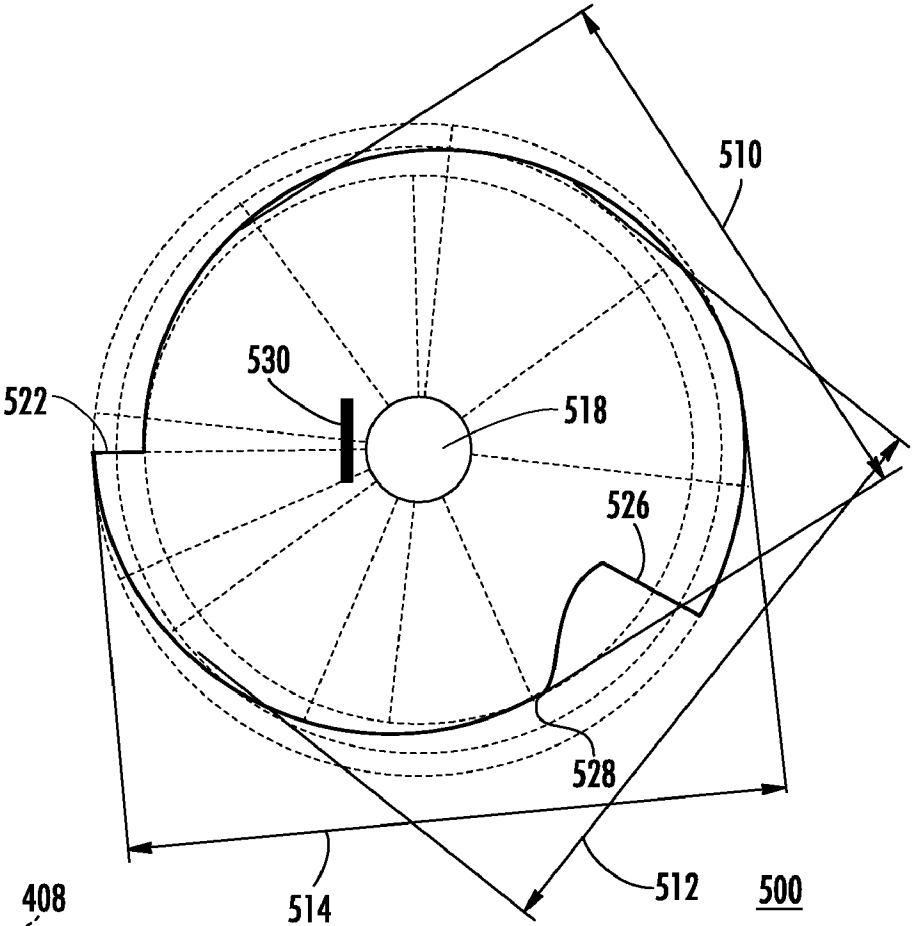
FIG. 7 is a top view of a multiple diameter gripping plate embodiment consistent with certain embodiments of the invention.

FIG. 7 depicts a variable diameter gripping plate 500 that can be adapted to a wide variety of hand sizes. In this gripping plate configuration, the lines defining the outer periphery of the gripping plate 500 from 522 to 526 and from 528 to 522 define spiral segments. These spiral segments are offset from center to provide a variety of usable dimensions in a single gripping plate. In this gripping plate configuration, the variable diameter gripping plate and has first and second opposed offset spiral segments defining a portion of a periphery thereof with the perimeter of the gripping plate 500 varying between the three diameters shown in dashed lines. These diameters in one embodiment (diameters 510, 512 and 514) can be approximately 5.15 inches, 5.62 inches and 6.10 inches from the center of aperture 518. In another embodiment, the diameters can be approximately 4.43 inches, 4.85 inches and 5.25 inches. Two such variable diameter disks with these dimensions can provide comfortable gripping for a wide range of hand sizes.

In this embodiment of a variable diameter gripping plate 500, the outer diameter drops abruptly at area 522 from diameter 514 to diameter 510 (traveling clockwise around the perimeter) and then gradually increases diameter until diameter 514 is reached around 160 degrees from area 522. At area 526, the outer diameter drops abruptly to approximately four inches and then curves outward to diameter 510 (still traveling clockwise). Once it reaches diameter 510, the curve gradually increases until it reaches diameter 514 at area 522. By providing a variable diameter around the periphery of gripping plate 500, different size hands can be more easily accommodated. This curve permits the user to find any number of areas of comfort to grip and adapts to a wide variety of hand sizes when using the weightlifting apparatus. The edge defined by the spiral segment between 528 and 522 is generally intended for the thumb, while the edge defined by the spiral segment between 522 and 526 is generally intended for the fingers. Of course, other grips could also be employed without departing from the invention. Many other irregular shapes, variable diameter shapes, or multi-diameter configurations could also be devised without departing from the present invention.

The gripping plate depicted in FIG. 7 also may have an area 530 for mounting clip 152 in this embodiment, but other embodiments can be adapted for use with other fixed or pivotal mounting arrangements for connection to bar 108, 208, 312 or 358. In such embodiments, collars, sleeves or other mounting arrangements can be readily provided. Other multi-diameter gripping plate arrangements can also be devised consistent with certain embodiments of the present invention. The gripping plate 500 as depicted is a right hand gripping plate. A left hand gripping plate is similarly shaped with the clip mounted to the other side.

Thus, one exemplary exercise apparatus consistent with certain embodiments of the present invention has a gripping plate and a weight connected to the gripping plate so that a user can exercise the hand, fingers and arms by lifting the weight by the gripping plate. The weight may be suspended from the gripping plate in certain embodiment by any suitable suspension mechanism including, but not limited to the bar described above. The gripping plate may be any of the following shapes: disk shaped, elliptical shaped, oval shaped, irregularly shaped, variable diameter shaped, multi-diameter shaped, hand contour shaped and gripping contour shaped or any other suitable shape consistent with the intended uses described herein. The gripping plate may be made of a rigid, firm or flexible material. In certain embodiments, the gripping plate incorporates a cavity, and the user can selective place weights within the cavity, as will be described later.

In certain embodiments, the gripping plate may be a variable diameter gripping plate in which the perimeter that varies in diameter between three diameters—a narrower diameter, an intermediate diameter and a wider diameter. In one embodiment, the outer diameter drops abruptly at a first point on the perimeter the wider diameter to the narrower diameter and then gradually increases diameter until the wider diameter is reached about 160 degrees from area first point; and wherein at a second point perimeter drops abruptly to beyond the narrower diameter then curves outward to the narrower diameter, and then reaches the narrower diameter at which point the perimeter gradually increases in diameter until it reaches the wider diameter at the first point. In certain embodiments, the narrower diameter, the intermediate diameter and the wider diameter can be approximately 5.15 inches, 5.62 inches and 6.10 inches respectively from a central point. In another embodiment, the diameters can be approximately 4.43 inches, 4.85 inches and 5.25 inches. Other arrangements of offset opposed spirals or other irregular shapes can also be used to define the perimeter of a gripping plate consistent with certain embodiments of the present invention.

Figure 8:
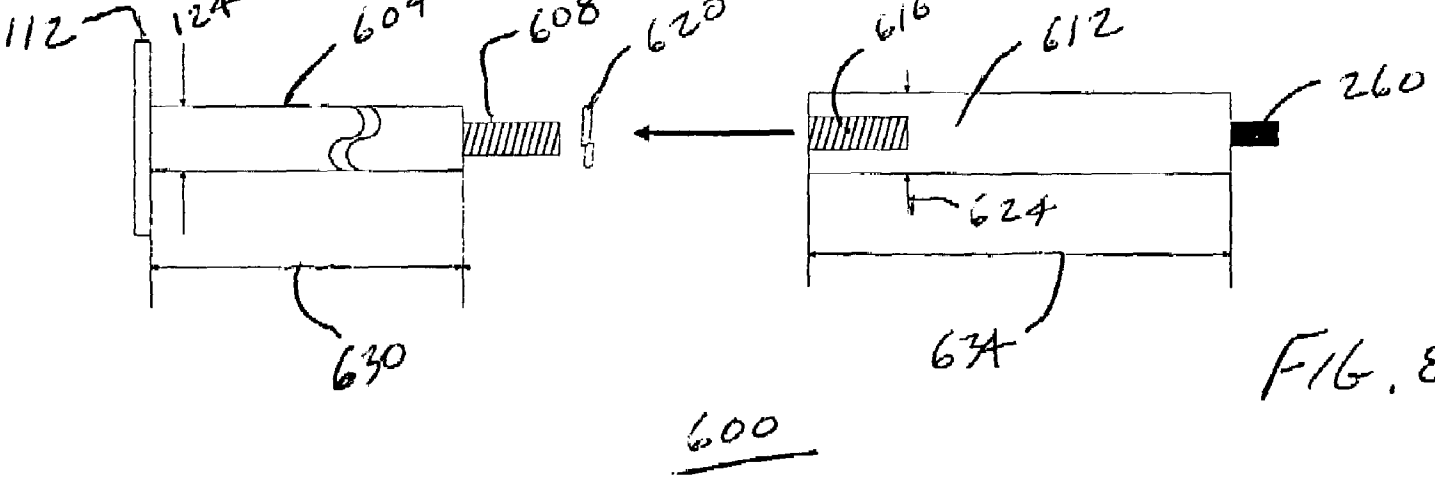
FIG. 8 is a side view of a two part handle assembly consistent with certain embodiments of the present invention.

FIG. 8 depicts another embodiment 600 of the handle portion of an exercise device consistent with the present invention. In this embodiment, the handle is fabricated in two parts. The weight carrying part 604 has diameter 124 suitable for accepting weights and an end cap 112 at one end. The other end of part 604 has a threaded member 608 extending outward therefrom with the threaded member centered along the center axis of the weight carrying part. A handle part 612 may then have a mating female thread 616 in an end thereof that engages the threaded member 608, with a lock washer 620 therebetween, to form a complete handle. The diameter of the handle part 612 may be larger in diameter 624 (e.g., about 1.25 to 1.5 inches) to prevent weights from sliding toward the user's hands, but a clamp or collar or other mechanism is still suggested for use in firmly securing the weights against the end cap 112. The other end of the handle part 612 can be adapted for pivotal attachment of the gripping disks. In one embodiment, the two part handle mechanism 600 may have lengths of approximately eleven inches at dimension 630 and about nine inches at 634, but other lengths are also consistent with certain embodiments of the present invention.

Figure 9:
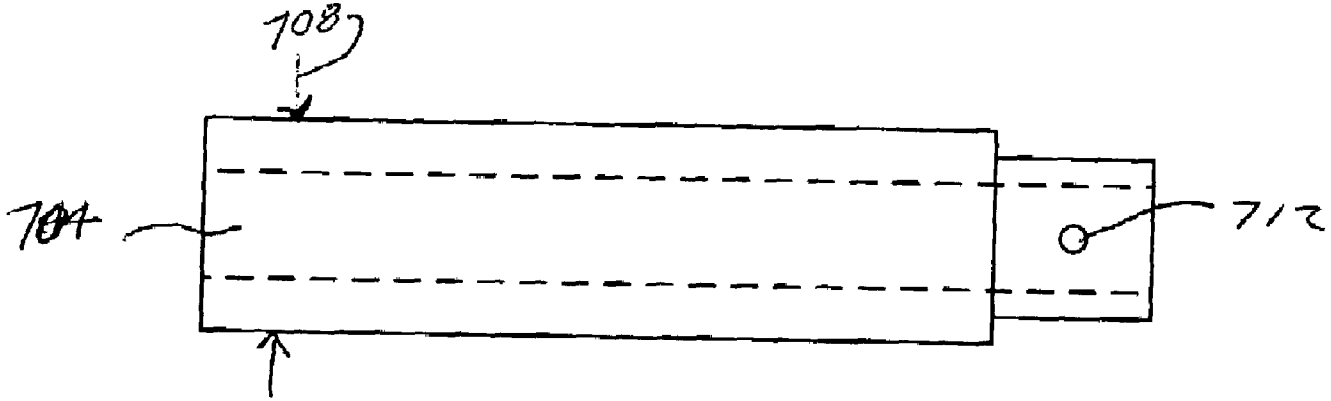
FIG. 9 is a side view of a handle sleeve consistent with certain embodiments of the present invention.

When gripping disks are not being used for a particular exercise, it may be desirable to provide another handle to the bar handles such as 108. This permits the user to carry out hand, wrist, arm and shoulder exercises using the bar and weight without the gripping plate. In such cases, a sleeve handle such as handle 700 of FIG. 9 can be used if desired. In this embodiment, a sleeve incorporates a central bore 704 running lengthwise that is appropriately dimensioned to receive the bar 108 to provide an area of larger diameter 708 that may be more comfortable for average to large sized hands (e.g., approximately 1.25 inches in diameter). The bar may be used directly as a handle for smaller hands or if otherwise desired. The handle sleeve may also be padded or have a textured outer surface and may be coated with foam, rubber, leather, plastic or other materials that may be desirable for providing an enhanced gripping surface. The sleeve may be held in place by alignment of an aperture 712 situated near one end with aperture 132 and insertion of a pin or a bolt or the like therethrough.

For the embodiments described above, the gripping plate may be made of any material that can support the weight used for carrying out the exercises. Such materials as metal, wood, plastics, etc. are all suitable. In other embodiments, the gripping plate may be used without the rod and barbell weights to carry out exercises. In one exemplary embodiment, shown in FIG. 10, a variable diameter gripping plate may be shaped as shown similar to gripping plate 500. A central aperture 804 can be used to directly support a customized weight of any suitable configuration that attaches directly to the aperture. In this example, a weighted ball 812 can be held in place by a friction fit. In another embodiment, the weight can be integrated into the gripping plate. In other embodiments, a compartment can be formed in or attached to the gripping plate into which the user can add selective amounts of weight as desired for a particular exercise. In the exemplary embodiment illustrated, the thickness tapers outward from diameter 816 and can be, for example 1.25 inches at 820 and 0.5 inches at 824. Cavity 804 may be, for example, three inches in diameter at diameter 816. Other dimensions may also be suitable for implementation of certain embodiments consistent with the present invention. In this case, the gripping plate may be made with any desired degree of firmness or flexibility in order to accommodate the hand, finger or arm exercises contemplated. In one embodiment, the gripping plate may be made of a firm but flexible rubber material (or similar) so that the gripping plate may be used in exercises in which the gripping plate is flexed and/or squeezed to carry out various hand and finger exercises.

Thus, in accordance with certain embodiments consistent with the present invention, a weightlifting apparatus has a bar having a first and a second opposing end. A weight having a central aperture is dimensioned so that the bar can be passed through the aperture. The bar has an end cap having an outer dimension larger than that of the bar and the aperture, with the end cap being situated adjacent the first end of the bar. The bar passes through the central aperture and rests against the end cap. A clamp secures the weight to the bar adjacent the end cap. A gripping plate has a clip attached thereto for attachment to the bar. An aperture through the bar adjacent the second end of the bar is provided for pivotal attachment of the gripping plate using a pin passing through the clip. The gripping plate can be shaped in one of the following shapes: disk shaped, elliptical shaped, oval shaped, irregularly shaped, multi-diameter shaped, hand contour shaped and gripping contour shaped, for example, or any other suitable shape. A sleeve can slide over the bar to form a handle near the second end. The bar can be a one part bar or a two part bar with a weight carrying part and a handle part, connected together by a threaded engagement.

Many variations will occur to those skilled in the art upon consideration of the present teachings. For example, the clamp can be replaced with any type of clamping or retaining mechanism that holds the weights in place. Instead of variable off the shelf weights, custom or fixed weights can be substituted. The handle can be made of metal or any other suitable material. Other pivotal attachments schemes or suspension attachment schemes can be devised and other variations can be devised without departing from the invention. In other embodiments, the gripping plate can have any desired degree of flexibility or rigidity and may incorporate a compartment into which weights are added to vary the weight of the gripping plate. Other variations will occur to those skilled in the art upon consideration of the present teaching.

While the invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations.

What is claimed is:

1. A weightlifting apparatus for use in conjunction with an exercise weight of the type that has a central aperture that permits the weight to be secured to various weightlifting appliances, comprising:

a bar having a first and a second opposing end;

means for securing the weight adjacent the first end of the bar;

means, situated adjacent the second end of the bar for attachment of a gripping plate; and a gripping plate attached to the second end of the bar by the means for attachment of the gripping plate, wherein the gripping plate comprises a variable diameter gripping plate and has first and second opposed offset spiral segments defining a portion of a perimeter thereof.

2. The weightlifting apparatus in accordance with claim 1, wherein the means for securing the weight comprises an end cap having an outer dimension larger than that of the bar, and clamping means that clamps to the bar for securing the weight between the end cap and the clamping means.

3. The weightlifting apparatus in accordance with claim 2, wherein the clamping means comprises one of the following: a hinged clamp with a wing nut that draws the hinged clamp into engagement with the bar, a split shaft collar secured by a screw, and a collar that is secured to the bar using a set screw.

4. The weightlifting apparatus in accordance with claim 1, wherein the means for attachment comprises one of a hook and an eye, wherein the other of the hook and eye is attached to the gripping plate.

5. The weightlifting apparatus in accordance with claim 1, wherein the means for attachment comprises an aperture in the bar near the second end for receiving a pin that attaches to the gripping plate.

6. The weightlifting apparatus in accordance with claim 1, further comprising a sleeve that slides over the bar and forms a handle near the second end.

7. The exercise apparatus in accordance with claim 1, wherein the gripping plate has a perimeter that varies in diameter between three diameters—a narrower diameter, an intermediate diameter and a wider diameter.

8. The exercise apparatus in accordance with claim 7, wherein the outer diameter drops abruptly at a first point on the perimeter from the wider diameter to the narrower diameter and then gradually increases diameter until the wider diameter is reached about 160 degrees from the first point; and wherein at a second point the perimeter drops abruptly to beyond the narrower diameter then curves outward to the narrower diameter, and then reaches the narrower diameter at which point the perimeter gradually increases in diameter until it reaches the wider diameter at the first point.

9. The exercise apparatus in accordance with claim 7, wherein the narrower diameter, the intermediate diameter and the wider diameter are approximately 5.15 inches, 5.62 inches and 6.10 inches respectively from a central point.

10. The exercise apparatus in accordance with claim 7, wherein the narrower diameter, the intermediate diameter and the wider diameter are approximately 4.43 inches, 4.85 inches and 5.25 inches respectively from a central point.

11. The weightlifting apparatus in accordance with claim 1, wherein the bar comprises a two part bar with a weight carrying part and a handle part, connected together by a threaded engagement.

12. The weightlifting apparatus in accordance with claim 1, wherein the means for attachment provides pivotal attachment.

13. A weightlifting apparatus for use in conjunction with an exercise weight of the type that has a central aperture that permits the weight to be secured to various weightlifting appliances, comprising:

a bar having a first and a second opposing end;

an end cap having an outer dimension larger than that of the bar adjacent the bar at the first end;

means for attaching the weight to the bar adjacent the end cap to provide increased weight at the first end of the bar;

a sleeve that slides over the bar and forms a handle with diameter greater than that of the bar at the second end;

a gripping plate; and means, situated adjacent the second end of the bar for selective attachment of either the gripping plate or the sleeve to the bar.

14. The weightlifting apparatus in accordance with claim 13, wherein the attaching means comprises one of the following: a hinged clamp with a wing nut that draws the hinged clamp into engagement with the bar, a split shaft collar secured by a screw, and a collar that is secured to the bar using a set screw.

15. The weightlifting apparatus in accordance with claim 13, wherein the means for attachment comprises means for pivotal attachment, and wherein the means for attachment comprises one of a hook and an eye, wherein the other of the hook and eye is attached to the gripping plate.

16. The weightlifting apparatus in accordance with claim 13, wherein the means for attachment comprises means for pivotal attachment, and wherein the means for attachment comprises an aperture in the bar near the second end for receiving a pin that pivotally attaches to the gripping plate.

17. The weightlifting apparatus in accordance with claim 13, wherein the gripping plate comprises a first gripping plate, and further comprising a second gripping plate, wherein the second gripping plate has a size that differs from the first gripping plate, and wherein the means for attachment comprises means for attaching either the first gripping plate, the second gripping plate or the sleeve.

18. The exercise apparatus in accordance with claim 13, wherein the gripping plate has a perimeter that varies in diameter between three diameters—a narrower diameter, an intermediate diameter and a wider diameter.

19. The exercise apparatus in accordance with claim 18, wherein the outer diameter drops abruptly at a first point on the perimeter from the wider diameter to the narrower diameter and then gradually increases diameter until the wider diameter is reached about 160 degrees from the first point; and wherein at a second point the perimeter drops abruptly to beyond the narrower diameter then curves outward to the narrower diameter, and then reaches the narrower diameter at which point the perimeter gradually increases in diameter until it reaches the wider diameter at the first point.

20. The exercise apparatus in accordance with claim 18, wherein the narrower diameter, the intermediate diameter and the wider diameter are approximately 5.15 inches, 5.62 inches and 6.10 inches respectively from a central point.

21. The exercise apparatus in accordance with claim 18, wherein the narrower diameter, the intermediate diameter and the wider diameter are approximately 4.43 inches, 4.85 inches and 5.25 inches respectively from a central point.

22. The exercise apparatus in accordance with claim 13, wherein the gripping plate comprises a variable diameter gripping plate and has first and second opposed offset spiral segments defining a portion of the perimeter thereof.

23. The weightlifting apparatus in accordance with claim 13, wherein the bar comprises a two part bar with a weight carrying part and a handle part, connected together by a threaded engagement.

24. A weightlifting apparatus; comprising:

a bar having a first and a second opposing end;

a weight having a central aperture dimensioned so that the bar can be passed through the aperture;

an end cap having an outer dimension larger than that of the bar and the aperture, the end cap being situated adjacent the first end of the bar;

wherein the bar passes through the central aperture and the weight rests against the end cap;

a clamp that secures the weight to the bar adjacent the end cap;

a gripping plate having a clip attached thereto for attachment to the bar; and an aperture through the bar adjacent the second end of the bar for pivotal attachment of the gripping plate using a pin passing through the clip.

25. The weightlifting apparatus in accordance with claim 24, wherein the gripping plate is shaped in one of the following shapes: disk shaped, elliptical shaped, oval shaped, irregularly shaped, variable diameter shaped, multi-diameter shaped, hand contour shaped and gripping contour shaped.

26. The exercise apparatus in accordance with claim 24, wherein the gripping plate comprises a variable diameter gripping plate and has first and second opposed offset spiral segments defining a portion of a periphery thereof.

27. The weightlifting apparatus in accordance with claim 24, further comprising a sleeve that slides over the bar and forms a handle near the second end.

28. The weightlifting apparatus in accordance with claim 24, wherein the bar comprises a two part bar with a weight carrying part and a handle part, connected together by a threaded engagement.

29. An exercise apparatus, comprising:

a gripping plate, wherein the gripping plate has a perimeter that varies in diameter between three diameters—a narrower diameter, an intermediate diameter and a wider diameter, and wherein the outer diameter drops abruptly at a first point on the perimeter from the wider diameter to the narrower diameter and then gradually increases diameter until the wider diameter is reached about 160 degrees from the first point; and wherein at a second point the perimeter drops abruptly to beyond the narrower diameter then curves outward to the narrower diameter, and then reaches the narrower diameter at which point the perimeter gradually increases in diameter until it reaches the wider diameter at the first point; and a weight connected to the gripping plate so that a user can exercise the hand, fingers and arms by lifting the weight by the gripping plate.

30. The exercise apparatus in accordance with claim 29, wherein the weight is suspended from the gripping plate.

31. The exercise apparatus in accordance with claim 29, wherein the gripping plate is made of a rigid material.

32. The exercise apparatus in accordance with claim 29, wherein the weight is suspended from the gripping plate using a pivotal suspension mechanism.

33. The exercise in accordance with claim 29, wherein the weight is suspended using a bar to attach the weight to the gripping plate.

34. The exercise apparatus in accordance with claim 29, wherein the gripping plate is made of a flexible material.

35. The exercise apparatus in accordance with claim 29, wherein the gripping plate incorporates a cavity, and wherein the weight resides within the cavity.

36. The exercise apparatus in accordance with claim 29, wherein the weight is suspended using a bar to attach the weight to the gripping plate, and wherein the bar is attached to the gripping plate using a pin.

37. The exercise apparatus in accordance with claim 36, wherein the narrower diameter, the intermediate diameter and the wider diameter are approximately 5.15 inches, 5.62 inches and 6.10 inches respectively from a central point.

38. The exercise apparatus in accordance with claim 36, wherein the narrower diameter, the intermediate diameter and the wider diameter are approximately 4.43 inches, 4.85 inches and 5.25 inches respectively from a central point.

39. The exercise apparatus in accordance with claim 29, wherein the gripping plate has first and second opposed offset spiral segments defining a portion of the perimeter thereof.

40. An exercise apparatus, comprising:

a variable diameter gripping plate made of a flexible material that can be squeezed and flexed to carry out hand and finger exercises; and wherein the gripping plate has a variable diameter with first and second opposed offset spiral segments defining a portion of a perimeter thereof.

41. The exercise apparatus in accordance with claim 40, further comprising a weight connected to the gripping plate so that a user can exercise the hand, fingers and arms by lifting the weight by the gripping plate.

42. The exercise apparatus in accordance with claim 41, wherein the weight is suspended from the gripping plate.

43. The exercise apparatus in accordance with claim 41, wherein the weight is suspended from the gripping plate using a pivotal suspension mechanism.

44. The exercise apparatus in accordance with claim 40, wherein the gripping plate incorporates a cavity, and wherein a weight resides within the cavity.

45. The exercise apparatus in accordance with claim 40, wherein the gripping plate has a perimeter that varies in diameter between three diameters—a narrower diameter, an intermediate diameter and a wider diameter.

46. The exercise apparatus in accordance with claim 45, wherein the outer diameter drops abruptly at a first point on the perimeter from the wider diameter to the narrower diameter and then gradually increases diameter until the wider diameter is reached about 160 degrees from the first point; and wherein at a second point the perimeter drops abruptly to beyond the narrower diameter then curves outward to the narrower diameter, and then reaches the narrower diameter at which point the perimeter gradually increases in diameter until it reaches the wider diameter at the first point.

47. The exercise apparatus in accordance with claim 45, wherein the narrower diameter, the intermediate diameter and the wider diameter are approximately 5.15 inches, 5.62 inches and 6.10 inches respectively from a central point.

48. The exercise apparatus in accordance with claim 45, wherein the narrower diameter, the intermediate diameter and the wider diameter are approximately 4.43 inches, 4.85 inches and 5.25 inches respectively from a central point.

49. A weightlifting apparatus; comprising:

an elongate bar having a first and a second opposing end;

a weight having a central aperture dimensioned so that the bar can be passed through the aperture;

an end cap having an outer dimension larger than that of the bar and the aperture, the end cap being situated at the first end of the bar;

a clamp that secures the weight to the bar adjacent the end cap;

a cylindrical sleeve handle having an outer surface adapted for grasping, two ends and a central bore that permits the sleeve to slide over the bar, and further having an aperture adjacent one end of the sleeve handle;

the bar having a hole through the bar adjacent the second end of the bar; and a pin passing through the bar's hole and the sleeve handle's aperture securing the sleeve handle to the bar.

50. The weightlifting apparatus according to claim 49, wherein the outer surface is textured in a manner that provides an enhanced gripping surface.

51. The weightlifting apparatus according to claim 49, wherein the sleeve handle has a coating that provides an enhanced gripping surface.

52. The weightlifting apparatus according to claim 49, further comprising a gripping plate having an outer periphery that is defined at least in part by two offset spirals, and wherein the gripping plate is attached to the bar adjacent the second end of the bar in place of the handle, as an interchangeable accessory.

53. The weightlifting apparatus according to claim 52, wherein the gripping plate includes a collar that with an aperture, and wherein the gripping plate is attached to the bar using a pin passing through the aperture of the collar and the hole of the bar.

54. The weightlifting apparatus in accordance with claim 52, wherein the gripping plate is shaped in one of the following shapes: disk shaped, elliptical shaped, oval shaped, irregularly shaped, variable diameter shaped, multi-diameter shaped, hand contour shaped and gripping contour shaped.

55. The exercise apparatus in accordance with claim 52, wherein the gripping plate has a perimeter that varies in diameter between three diameters—a narrower diameter, an intermediate diameter and a wider diameter.

56. The exercise apparatus in accordance with claim 55, wherein the outer diameter drops abruptly at a first point on the perimeter from the wider diameter to the narrower diameter and then gradually increases diameter until the wider diameter is reached about 160 degrees from the first point; and wherein at a second point the perimeter drops abruptly to beyond the narrower diameter then curves outward to the narrower diameter, and then reaches the narrower diameter at which point the perimeter gradually increases in diameter until it reaches the wider diameter at the first point.

57. The exercise apparatus in accordance with claim 55, wherein the narrower diameter, the intermediate diameter and the wider diameter are approximately 5.15 inches, 5.62 inches and 6.10 inches respectively from a central point.

58. The exercise apparatus in accordance with claim 55, wherein the narrower diameter, the intermediate diameter and the wider diameter are approximately 4.43 inches, 4.85 inches and 5.25 inches respectively from a central point.

* * * * *

UNITED STATES PATENT AND TRADEMARK OFFICE

CERTIFICATE OF CORRECTION

PATENT NO. : 7,141,002 B2
APPLICATION NO. : 10/612645
DATED : November 28, 2006
INVENTOR(S) : Albert Louis Connelly It is certified that error appears in the above-identified patent and that said Letters Patent is hereby corrected as shown below:

In col. 5, line 23, After “aperture 354”, insert -- in --.

In col. 5, line 32, delete “aproximately four inches”.

Claims:

In col. 11, line 52, after “exercise” insert --apparatus--.

Replace Sheet 1 of the Drawing as follows:

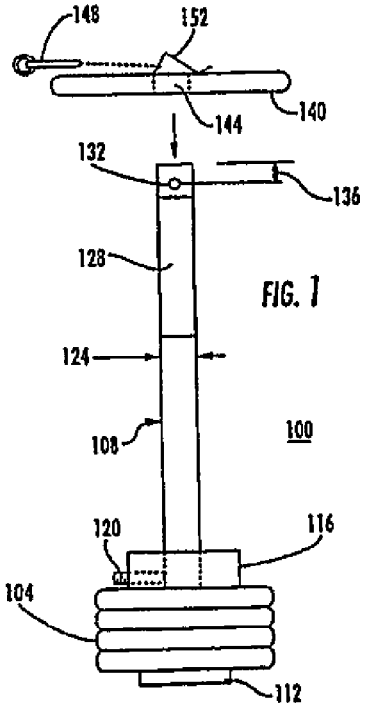

FIG. 1

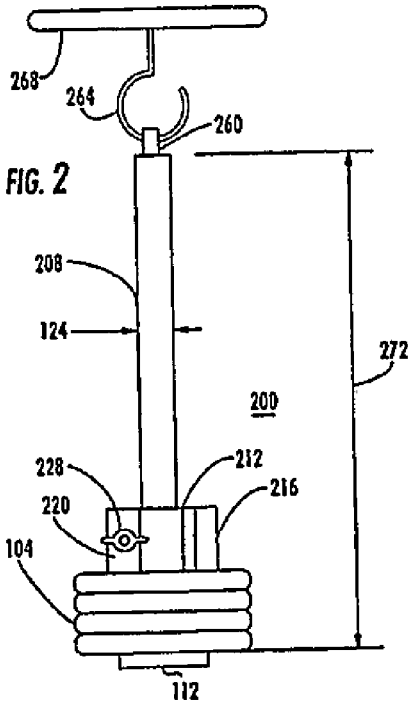

FIG. 2

UNITED STATES PATENT AND TRADEMARK OFFICE

CERTIFICATE OF CORRECTION

PATENT NO. : 7,141,002 B2 
APPLICATION NO. : 10/612645
DATED : November 28, 2006
INVENTOR(S) : Albert Louis Connelly It is certified that error appears in the above-identified patent and that said Letters Patent is hereby corrected as shown below:

Replace Sheet 2 of the Drawing as follows:

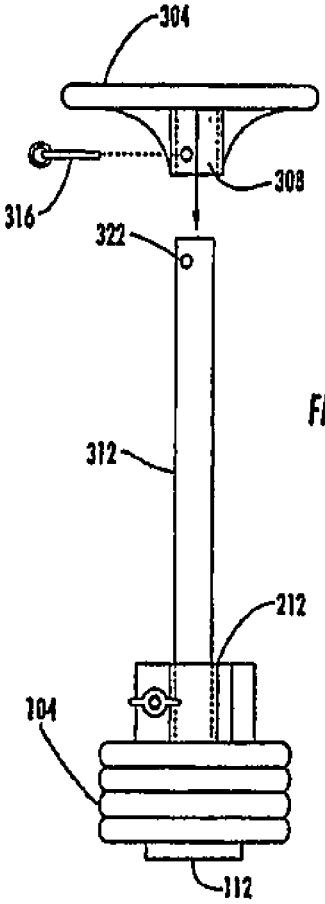

FIG. 3

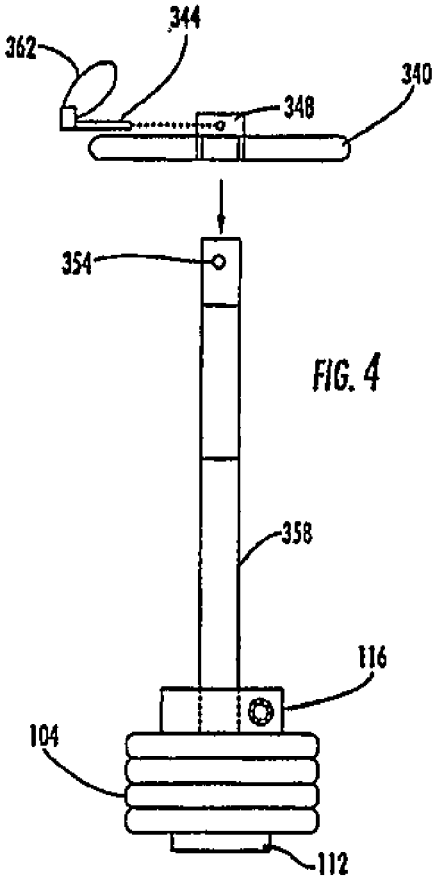

FIG. 4

UNITED STATES PATENT AND TRADEMARK OFFICE

CERTIFICATE OF CORRECTION

PATENT NO. : 7,141,002 B2 
APPLICATION NO. : 10/612645
DATED : November 28, 2006
INVENTOR(S) : Albert Louis Connelly It is certified that error appears in the above-identified patent and that said Letters Patent is hereby corrected as shown below:

Replace Sheet 4 of the Drawing as follows:

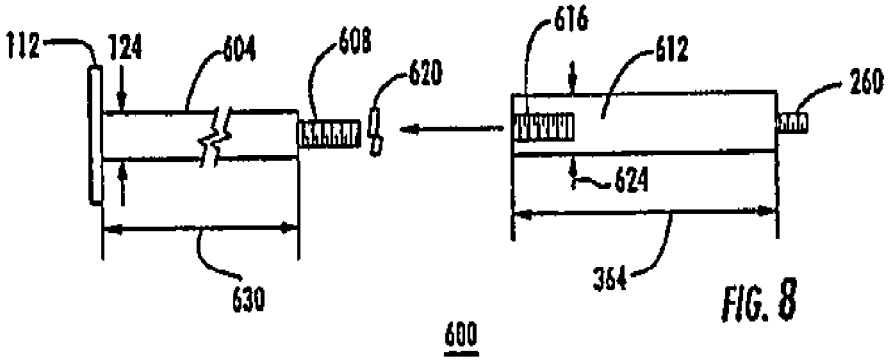

FIG. 8

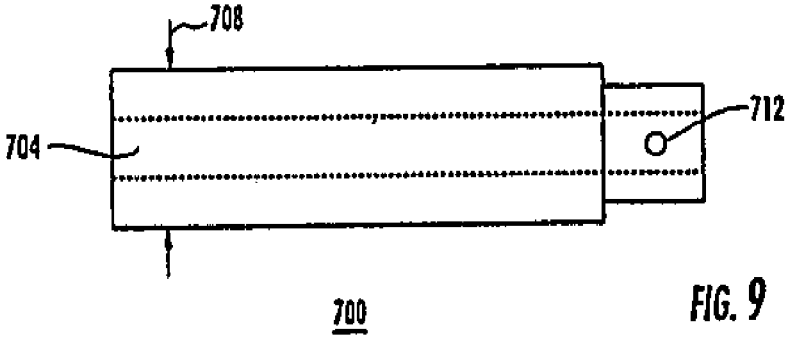

FIG. 9

UNITED STATES PATENT AND TRADEMARK OFFICE

CERTIFICATE OF CORRECTION

PATENT NO. : 7,141,002 B2 
APPLICATION NO. : 10/612645
DATED : November 28, 2006
INVENTOR(S) : Albert Louis Connelly It is certified that error appears in the above-identified patent and that said Letters Patent is hereby corrected as shown below:

Replace Sheet 5 of the Drawing as follows:

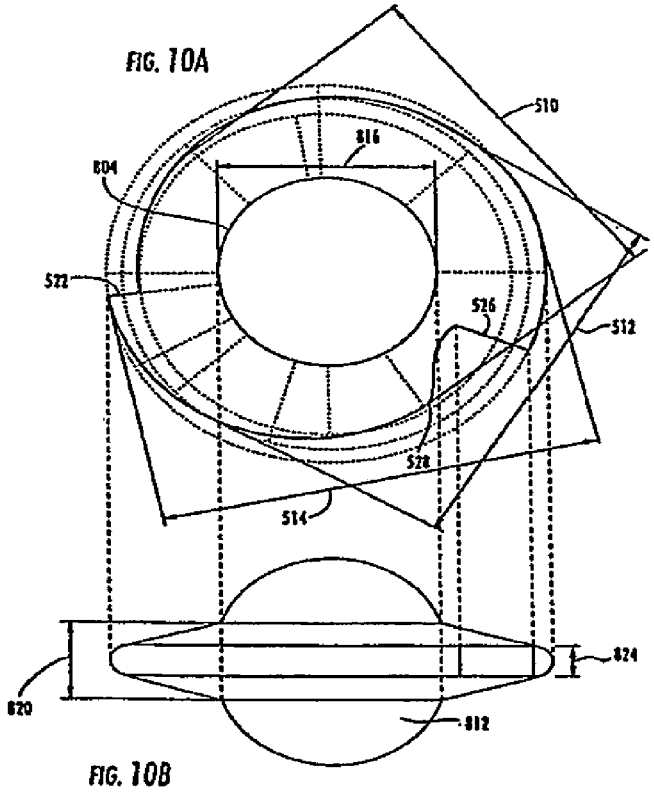

Signed and Sealed this

Twenty-seventh Day of February, 2007

JON W. DUDAS
*Director of the United States Patent and Trademark Office*